US006152051A

United States Patent [19]

Kiyama et al.

[11] Patent Number: 6,152,051

[45] Date of Patent: Nov. 28, 2000

[54] POWERED FUEL COMBUSTION BURNER WITH NOZZLE FLOW GUIDE

[75] Inventors: Kenji Kiyama; Toshikazu Tsumura; Tadashi Jimbo; Koji Kuramashi, all of Kure; Shigeki Morita, Hiroshima; Miki Mori, Kure, all of Japan

[73] Assignee: Babcock-Hitachi Kabushiki Kaisha, Tokyo, Japan

[21] Appl. No.: 09/051,744

[22] PCT Filed: Apr. 30, 1997

[86] PCT No.: PCT/JP97/01489

§ 371 Date: Apr. 20, 1998

§ 102(e) Date: Apr. 20, 1998

[87] PCT Pub. No.: WO98/08026

PCT Pub. Date: Feb. 26, 1998

[30] Foreign Application Priority Data

| | | | |
|---|---|---|---|
| Aug. 22, 1996 | [JP] | Japan | 8-221057 |
| Feb. 7, 1997 | [JP] | Japan | 9-025639 |

[51] Int. Cl.[7] ..... F23C 1/10; F23D 1/00

[52] U.S. Cl. ..... 110/262; 110/104 B; 110/265; 431/181; 431/182; 431/8

[58] Field of Search ..... 110/104 B, 260, 110/261, 262, 263, 264, 265, 347; 431/8, 9, 181, 182, 184, 185, 187, 188

[56] References Cited

U.S. PATENT DOCUMENTS

| | | | |
|---|---|---|---|
| 4,630,554 | 12/1986 | Sayler et al. | 110/264 |
| 4,838,185 | 6/1989 | Flament | 110/264 X |
| 5,090,339 | 2/1992 | Okiura et al. | 110/263 |
| 5,199,355 | 4/1993 | Larue | 110/261 |
| 5,231,937 | 8/1993 | Kobayashi et al. | 110/262 |
| 5,263,426 | 11/1993 | Morita et al. | 110/264 X |
| 5,567,141 | 10/1996 | Joshi et al. | 431/187 X |
| 5,685,242 | 11/1997 | Narato et al. | 110/262 |
| 5,832,847 | 11/1998 | Leisse et al. | 110/261 X |
| 5,842,426 | 12/1998 | Ohta et al. | 110/261 |

FOREIGN PATENT DOCUMENTS

| | | | |
|---|---|---|---|
| 489928 | 6/1992 | European Pat. Off. . | |
| 672863 | 9/1995 | European Pat. Off. . | |
| 628475 | 10/1927 | France | 110/261 |
| 3-50408 | 3/1991 | Japan | 110/263 |
| 4-20702 | 1/1992 | Japan | 110/263 |
| 5-272712 | 10/1993 | Japan | 110/263 |
| 1025965 | 6/1983 | U.S.S.R. | 110/265 |
| 704901 | 3/1954 | United Kingdom | 110/262 |
| 650833 | 3/1981 | United Kingdom | 110/261 |

*Primary Examiner*—Ira S. Lazarus
*Assistant Examiner*—Ljiljana V. Ciric
*Attorney, Agent, or Firm*—Antonelli, Terry, Stout & Kraus, LLP

[57] ABSTRACT

A combustion burner includes a mixture nozzle, a gas supply nozzle, and a flow guide. The mixture nozzle extends toward an interior of a furnace, and defines a mixture passage through which a mixture containing powdered solid fuel and gas for transferring the solid fuel flows. A distal end portion of the mixture nozzle is flared so that a flow passage area of the mixture passage increases progressively in a direction of flow of the mixture. The gas supply nozzle radially surrounds the mixture nozzle to define between the gas supply nozzle and the mixture nozzle a gas passage through which a combustion oxygen-containing gas flows toward the furnace. The flow guide is provided within the mixture nozzle at a position upstream of the flared portion of the mixture nozzle with respect to a flow of the mixture so as to make the mixture flow straight along an inner peripheral surface of the flared portion of the mixture nozzle.

5 Claims, 14 Drawing Sheets

POWERED FUEL COMBUSTION BURNER WITH NOZZLE FLOW GUIDE

TECHNICAL FIELD

This invention relates to a combustion burner.

BACKGROUND OF THE INVENTION

A burner of this type comprises a mixture nozzle, and a gas supply nozzle surrounding this mixture nozzle.

In a pulverized coal burner disclosed in JP-A-63-87508, an impeller for swirling an air-fuel mixture is provided within a mixture nozzle. The swirled mixture from an outlet of the mixture nozzle is rapidly diffused within a furnace, and is mixed with secondary air and tertiary air, supplied from a gas supply nozzle, in the vicinity of the outlet of the mixture nozzle. Therefore, a reduction area is not sufficiently formed, and a flame does not spread in the furnace. As a result, a part of fine pulverized coal remains unburned, and the production of NOx can not be suppressed.

In a pulverized coal burner disclosed in JP-A-60-200008, a throat portion is provided within a mixture nozzle, and an outlet of the mixture nozzle is flared. In this burner, as in the above-mentioned burner, an air-fuel mixture from an outlet of the mixture nozzle is rapidly diffused within a furnace, and is mixed with secondary air and tertiary air, supplied from a gas supply nozzle, in the vicinity of the outlet of the mixture nozzle. As a result, a part of fine pulverized coal remains unburned, and the production of NOx can not be suppressed.

BRIEF SUMMARY OF THE INVENTION

It is an object of this invention to provide a combustion burner which solves these problems, and can achieve low-NOx combustion.

To this end, according to one aspect of the present invention, there is provided a combustion burner comprising: a mixture nozzle which extends toward an interior of a furnace, and defines a mixture passage through which a mixture containing powdered solid fuel and gas for transferring the solid fuel flows, and a distal end portion of which mixture nozzle is flared so that a flow passage area of the mixture passage increases progressively in a direction of flow of the mixture; a gas supply nozzle radially surrounding the mixture nozzle and defining between the gas supply nozzle and the mixture nozzle a gas passage through which combustion oxygen-containing gas flows towards the furnace; and guide means provided within the mixture nozzle at a position upstream of the flared portion of the mixture nozzle with respect to a flow of the mixture so as to make the mixture flow straightly along an inner peripheral surface of the flared portion of the mixture nozzle.

According to another aspect of the present invention, there is provided a combustion burner comprising: a mixture nozzle extending towards an interior of a furnace, and defining a mixture passage through which a mixture containing powdered solid fuel and gas for transferring the solid fuel flows, and a distal end portion of which mixture nozzle is flared so that a flow passage area of the mixture passage increases progressively in a direction of flow of the mixture; a gas supply nozzle radially surrounding the mixture nozzle, and defining between the gas supply nozzle and the mixture nozzle a gas passage, through which combustion oxygen-containing gas flows towards the furnace, and a gas jet nozzle through which gas is injected radial inwardly towards the mixture flowed into the furnace from the distal end of the mixture nozzle.

DETAILED DESCRIPTION OF THE INVENTION

Figure 1:
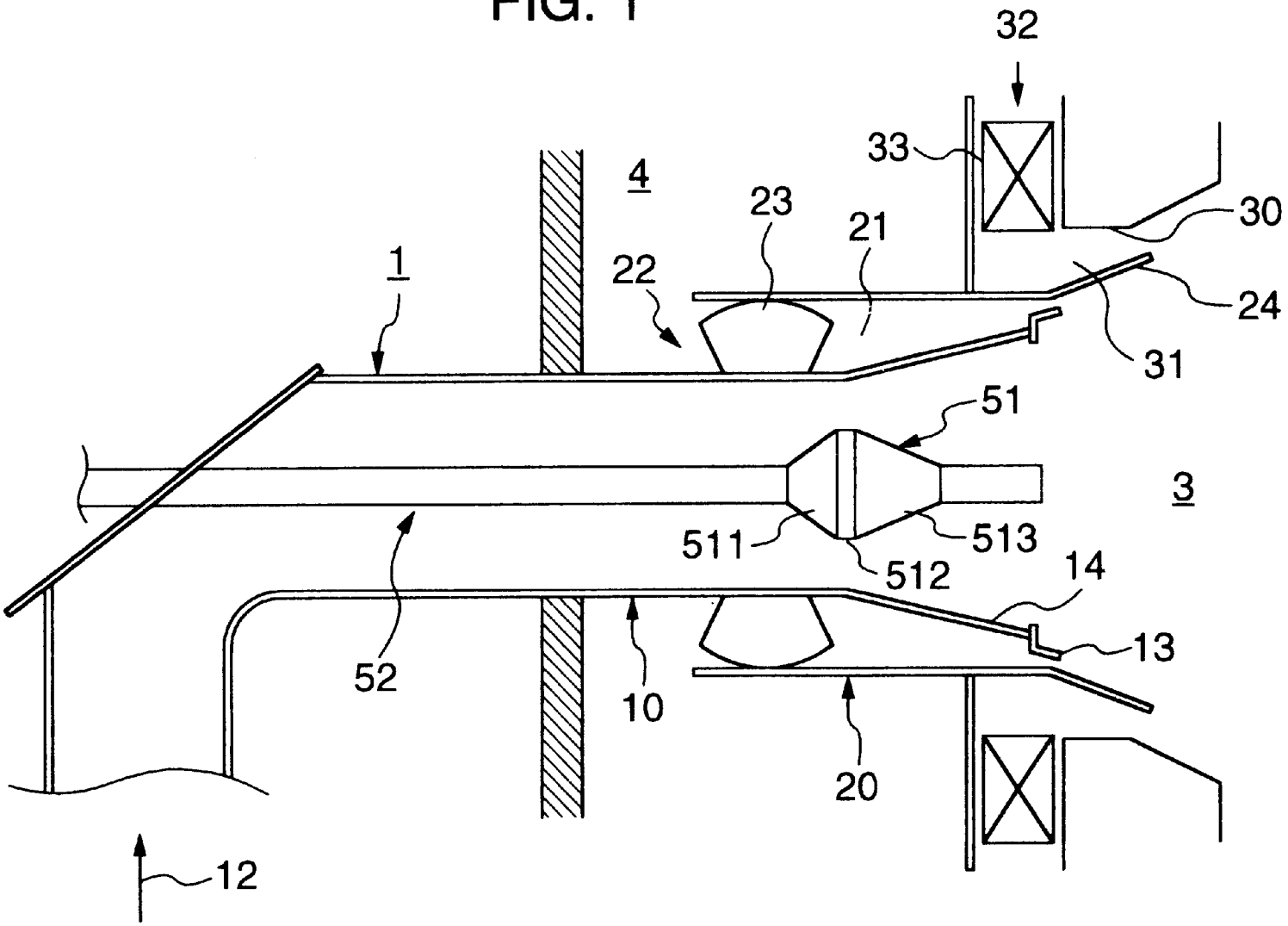
FIG. 1 is a cross-sectional view of an embodiment of a burner of the present invention.
Figure 2:
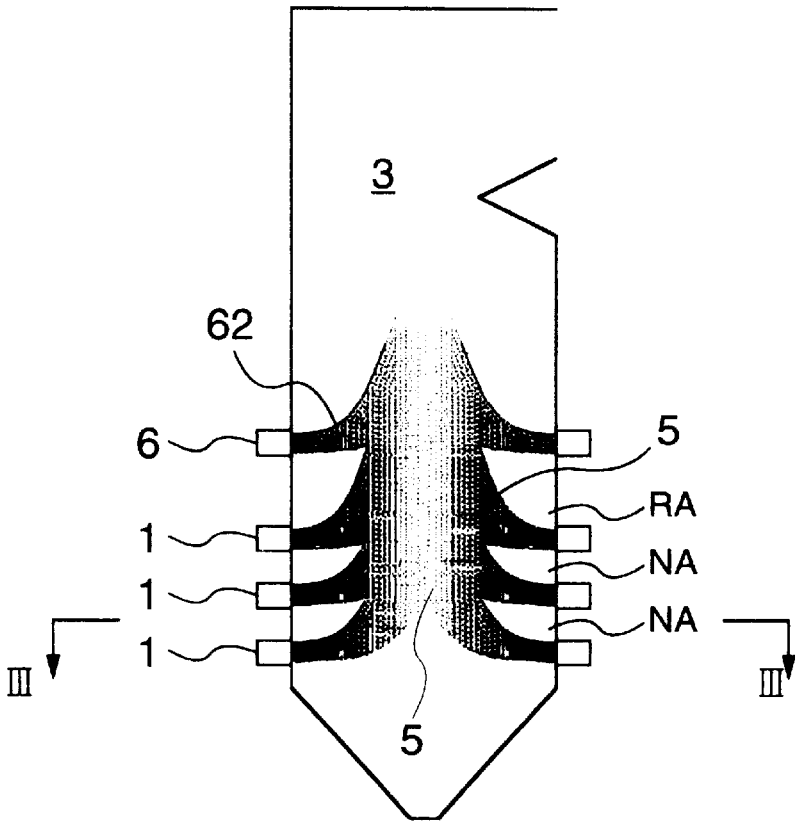
FIG. 2 is a cross-sectional view of a furnace of a boiler using the burners of FIG. 1, showing a condition of a flame in the furnace.
Figure 3:
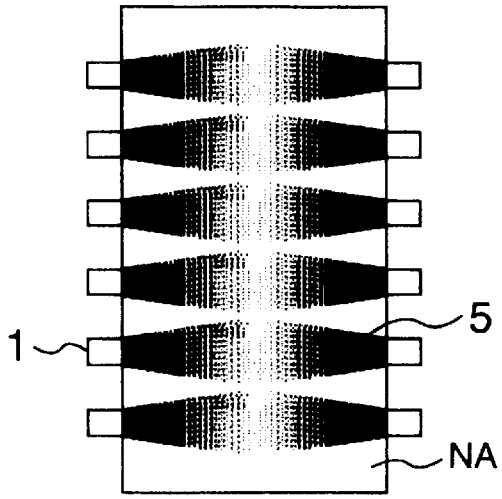
FIG. 3 is a cross-sectional view taken along the line III—III of FIG. 2.

A combustion burner 1 according to one embodiment of the present invention shown in FIG. 1, which is used in a boiler, comprises a mixture nozzle 10 through which a mixture 12 containing fine pulverized coal as solid fuel and primary air for transferring purposes flows. In this embodiment, as shown in FIGS. 2 and 3, twelve combustion burners 1 are arranged in an opposed manner in a common horizontal plane at a furnace 3, and also the combustion burners are arranged in three stages in a vertical direction. However, the number of the burners 1 as well as the number of stage is not limited to this arrangement.

The mixture 12 is supplied via the nozzle 10 into the furnace 3 through an opening 30 formed in the furnace 3. A gas supply nozzle 20 is provided around the nozzle 10. A secondary air passage 21 is defined between the nozzle 10 and the nozzle 20, and a tertiary air passage 31 is defined between the nozzle 20 and the opening 30 of the furnace 3. A swirl-producing device 23 is provided in the secondary air passage 21 so as to swirl the secondary air 22 from a wind box 4. A swirl-producing device 33 is provided in the tertiary air passage 31 so as to swirl the tertiary air 32 from the wind box 4.

A ring-shaped flame stabilizer 13 is provided at a distal end of the nozzle 10, which has a peripheral edge portion of an L-shaped cross-section. A distal end portion 14 of the nozzle 10 is flared so that its flow passage area increases progressively along the flow of the mixture 12.

A guide 51 is disposed in the nozzle 10 so that the mixture 12 can flow radially outwardly along the flared distal end portion 14. The guide 51 is provided at a distal end of an oil burner 52. The oil burner 52 is used when activating the boiler and in a low-load condition. In the case where no oil burner is needed, the guide 51 is placed by a suitable support.

The guide 51 has a first guide portion 511, a second guide portion 512 and a third guide portion 513 along the flow of the mixture 12. The outside dimension of the first guide portion 511 increases progressively in the direction of flow of the mixture 12, and the outside dimension of the third guide portion 513 decreases progressively in the direction of flow of the mixture 12. Both are interconnected by the second guide portion 512 having a constant outside dimension. The guide 51 is located upstream side of the flared distal end portion 14 with respect to the flow of the mixture 12.

Figure 4:
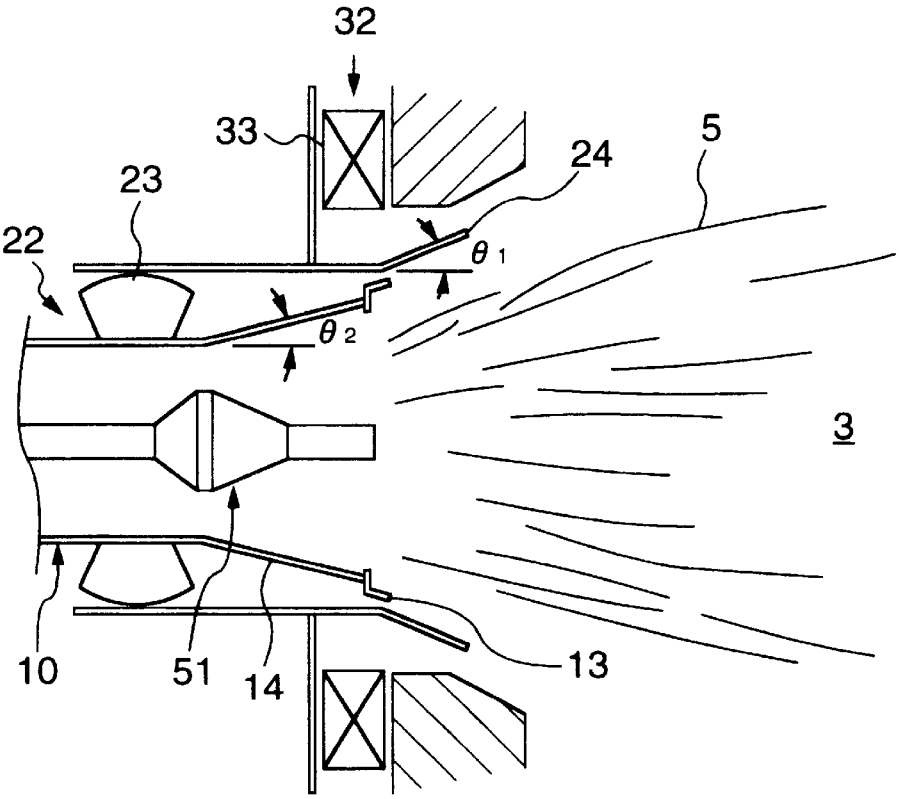
FIG. 4 is a cross-sectional view showing the condition of the flame in the furnace.

In the burner 1 of this construction, a flame 5 is spread outwardly as shown in FIG. 4. As a result, unavailable areas NA of the furnace are reduced as shown in FIGS. 2 and 3. Air supply ports 6 are provided downstream of the burners 1, and additional air 62 is supplied into the furnace 3 through these air supply ports. In reduction areas RA delimited by the flames 5 from the most downstream burners 1 and the additional air flows 62 from the air ports 6, the combustion gas stays for a longer time period. Therefore, the NOx concentration in the combustion gas is reduced, so that the combustion efficiency is enhanced. The unburned pulverized coal is completely burned by the air 62 from the air ports 6.

Figure 5:
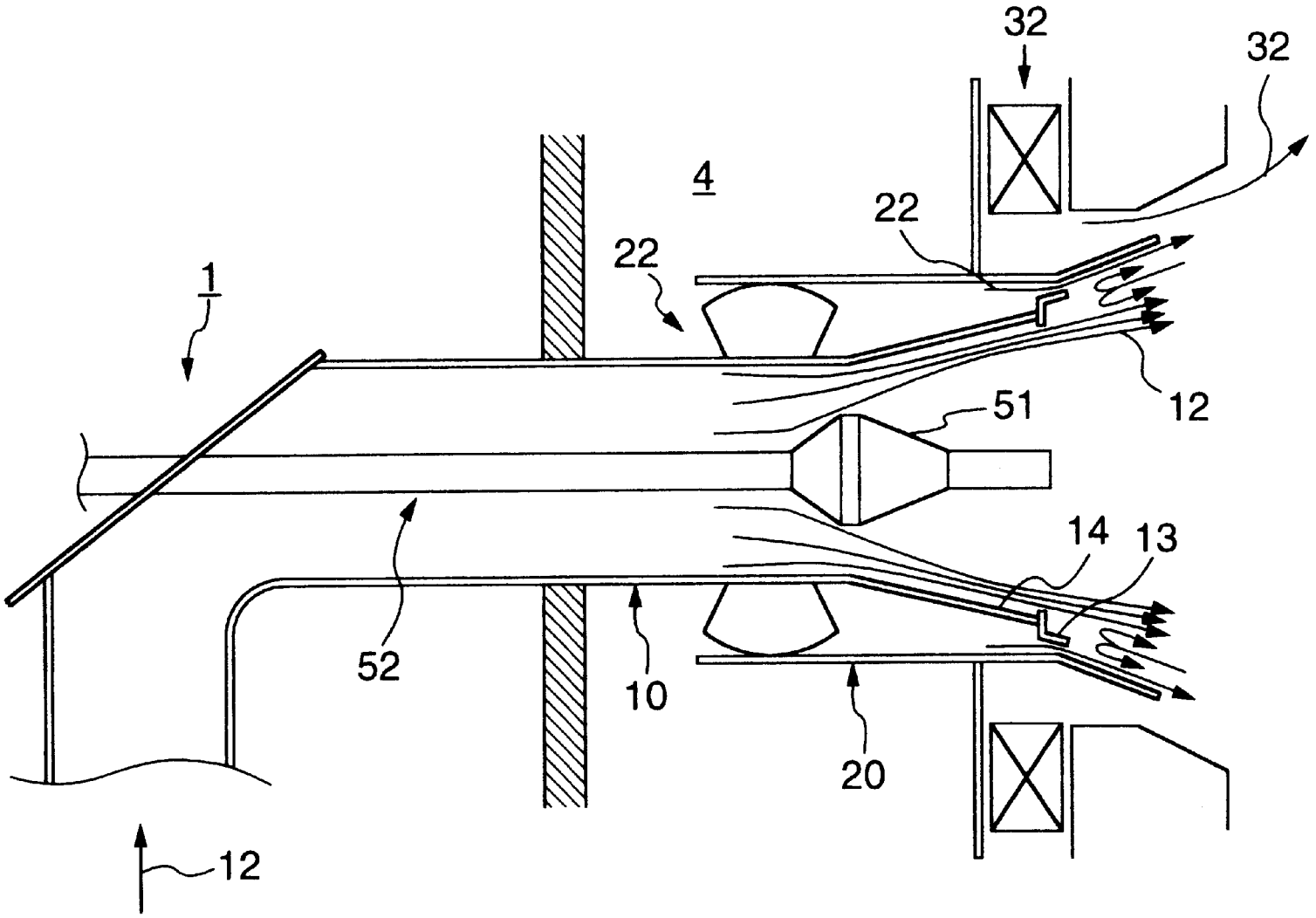
FIG. 5 is a cross-sectional view showing a flow of a mixture and a flow of combustion air in the burner.

The momentum of the pulverized coal is greater than that of the primary air, and therefore the pulverized coal is condensed at a region close to the peripheral wall of the flared distal end portion 14 of the nozzle 10, as shown in FIG. 5. Therefore, the combustion efficiency in the vicinity of the outlet of the burner is enhanced, so that the flame 5 is thermally expanded to be more spread.

In this embodiment, the nozzle 20 is provided at a distal end thereof with separation means in the form of a flared, annular deflection guide tube 24. Accordingly, the primary air 22 and the tertiary air 23, which are swirled respectively by the swirl-producing devices, flow forwardly and radially outwardly. As shown in the drawings, if the annular deflection guide tube 24 is so designed that the angle $\theta_1$ between the annular deflection guide tube 24 and the axis of the mixture nozzle 10 is equal to or larger than the angle $\theta_2$ between the flared distal end portion 14 and the axis of the mixture nozzle 10, the secondary air and the tertiary air are more spread radially outwardly. As a result, an air-insufficient area, that is, a fuel-excessive area is formed in a central portion of the flame, thereby enabling the low NOx combustion.

Figure 6:
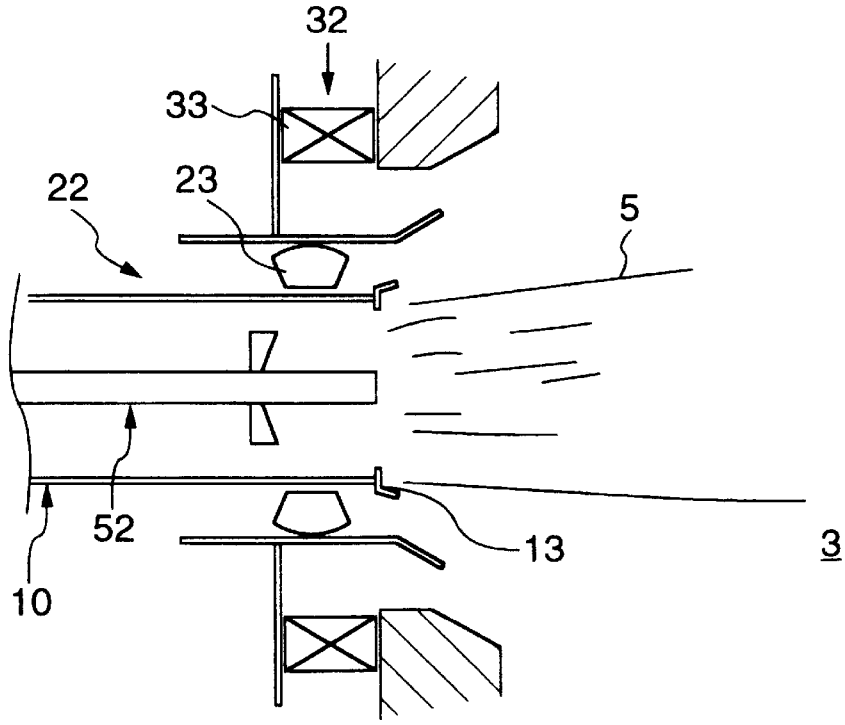
FIG. 6 PRIOR ART
FIG. 6 is a cross-sectional view showing a condition of a flame in a furnace using a conventional burner.
Figure 7:
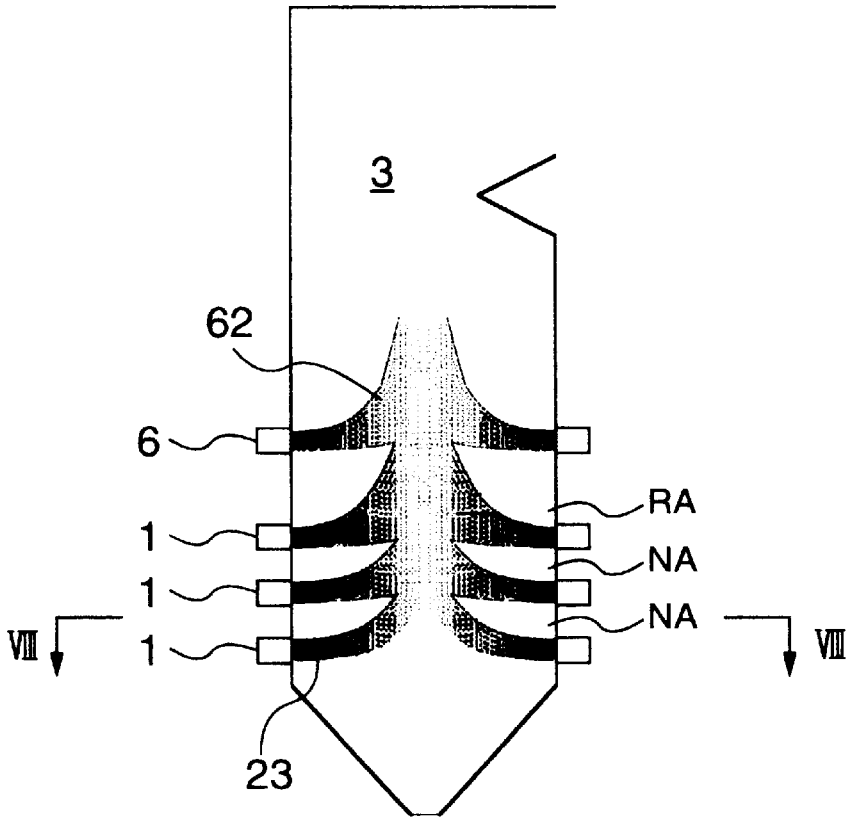
FIG. 7 is a cross-sectional view of the furnace of a boiler using the conventional burners, showing the condition of the flame in the furnace.
Figure 8:
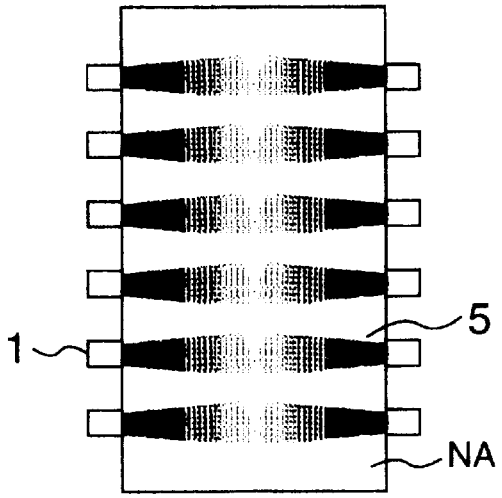
FIG. 8 is a cross-sectional view taken along the line VIII—VIII of FIG. 7.

On the other hand, in a conventional burner shown in FIG. 6, a mixture nozzle 10 does not have the flared distal end portion 14, and the guide 51 is not provided within the mixture nozzle. Therefore, a flame does not spread, but behaves as a free jet. As a result, as shown in FIGS. 7 and 8, the area in a furnace 3 where flames are not present, that is, the unavailable area NA in the furnace become larger as compared with the furnace of FIGS. 2 and 3. Further, the time period of stay of the pulverized coal in reduction areas RA becomes shorter, and then the NOx concentration in the combustion gas can not be lowered.

Figure 9:
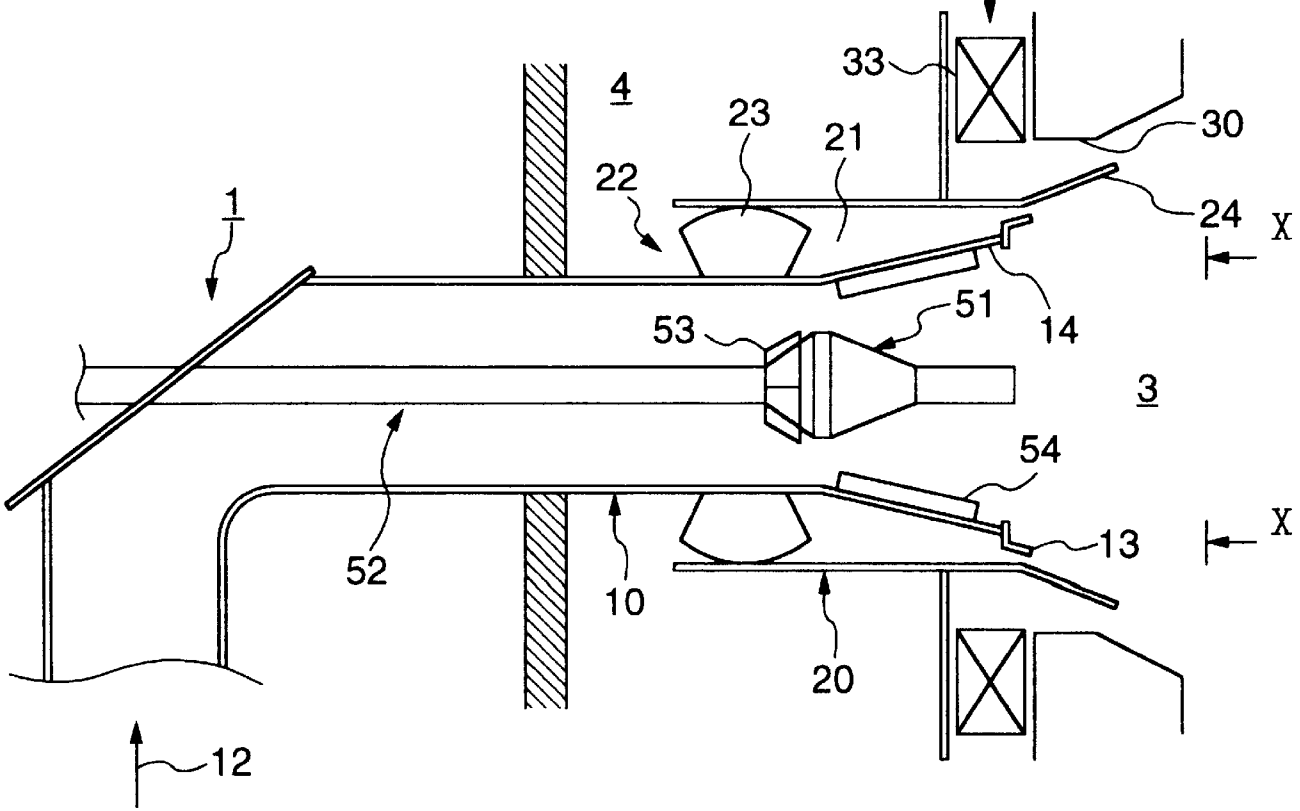
FIG. 9 is a cross-sectional view showing another embodiment of a burner.

As compared with the burner of FIG. 1, a burner 1 of FIG. 9, which is another embodiment, further comprises a swirl-producing device 53 for swirling the mixture 12, and flow-rectifying plates 54. Hereinafter, the parts which are identical in construction or correspond in effect to those of the above embodiment will be designated by the same reference numerals, respectively, and explanation thereof will be omitted.

Figure 10:
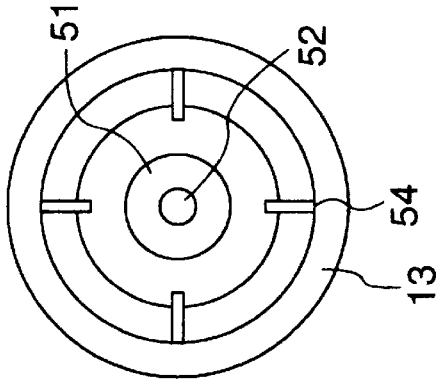
FIG. 10 is a cross-sectional view taken along the line X—X of FIG. 9.

The swirl-producing device 53 is placed upstream of the guide 51. Accordingly, a larger amount of pulverized coal in the mixture flows along the inner peripheral surface of the flared distal end portion 14, thereby enabling the flame 5 to be further spread. However, if the mixture is supplied in the form of a swirling flow into a furnace 3, such mixture is immediately mixed with the secondary air or the tertiary air in the vicinity of the burner 1, so that the low NOx combustion is not effected. Therefore, the plurality of flow-rectifying plates 54 are provided on the inner peripheral surface of the flared distal end portion 14 disposed downstream of the swirl-producing device 53 (FIG. 10). With this construction, a circumferential velocity component of the mixture 12 is suppressed while a forward velocity component thereof is increased, and then the mixture is mixed with the secondary air and the tertiary air at a location far from the burner 1. As a result, the reduction areas are increased, so that the low NOx combustion is possible.

Figure 11:
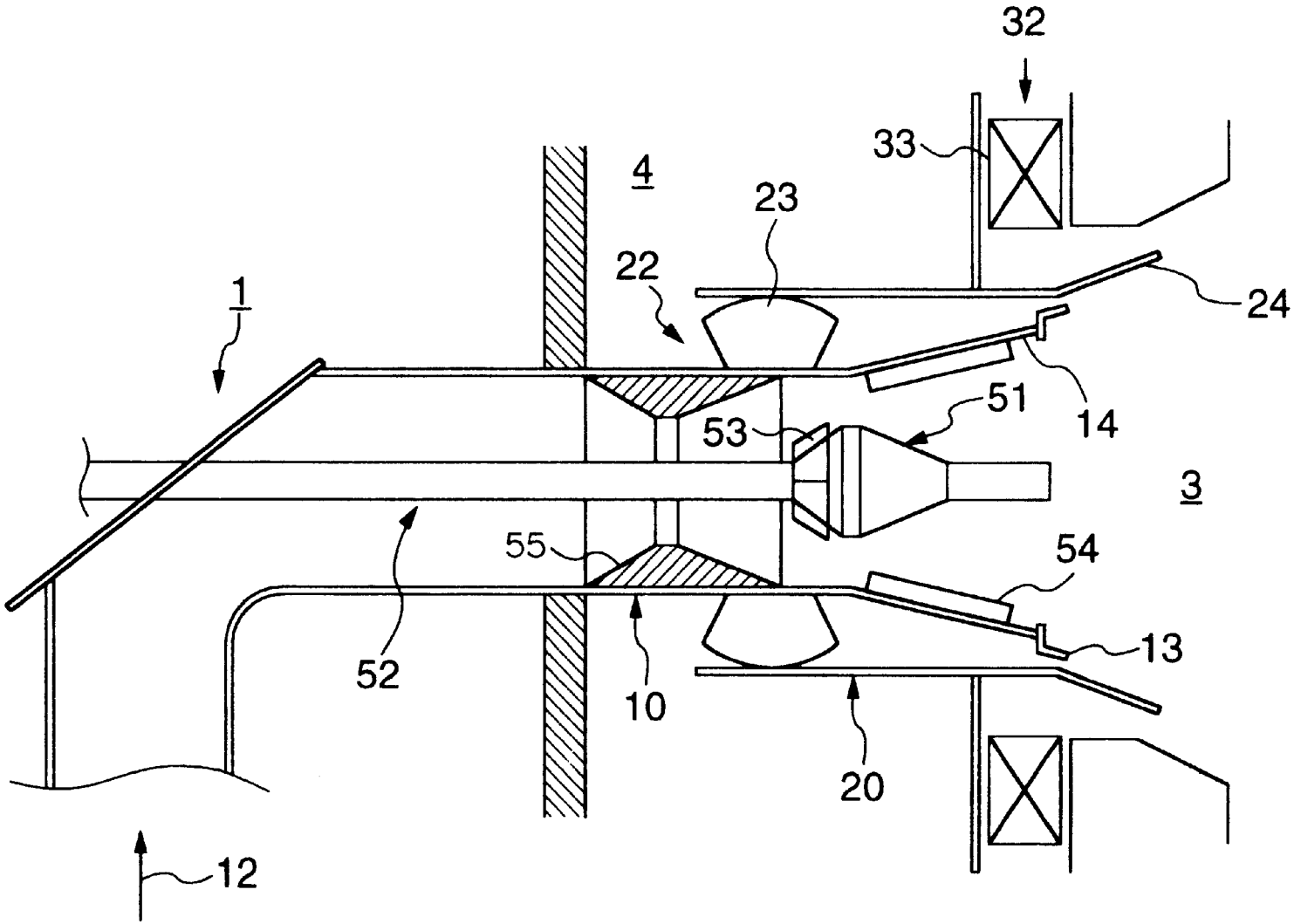
FIGS. 11 to 13 are cross-sectional views showing further embodiments of burners, respectively.

As compared with the embodiment of FIG. 9, a burner 1 of FIG. 11, which is another embodiment, further comprises a Venturi tube 55 provided upstream of the swirl-producing device 53. A throat portion of the Venturi tube 55 once converges the pulverized coal in an air-fuel mixture toward a radially-central portion of the mixture nozzle 10, and directs it toward the swirl-producing device 53. With this construction, the pulverized coal in the mixture can flow more efficiently along the inner peripheral surface of the flared distal end portion 14. Therefore, the generation of NOx can be more suppressed.

Figure 12:
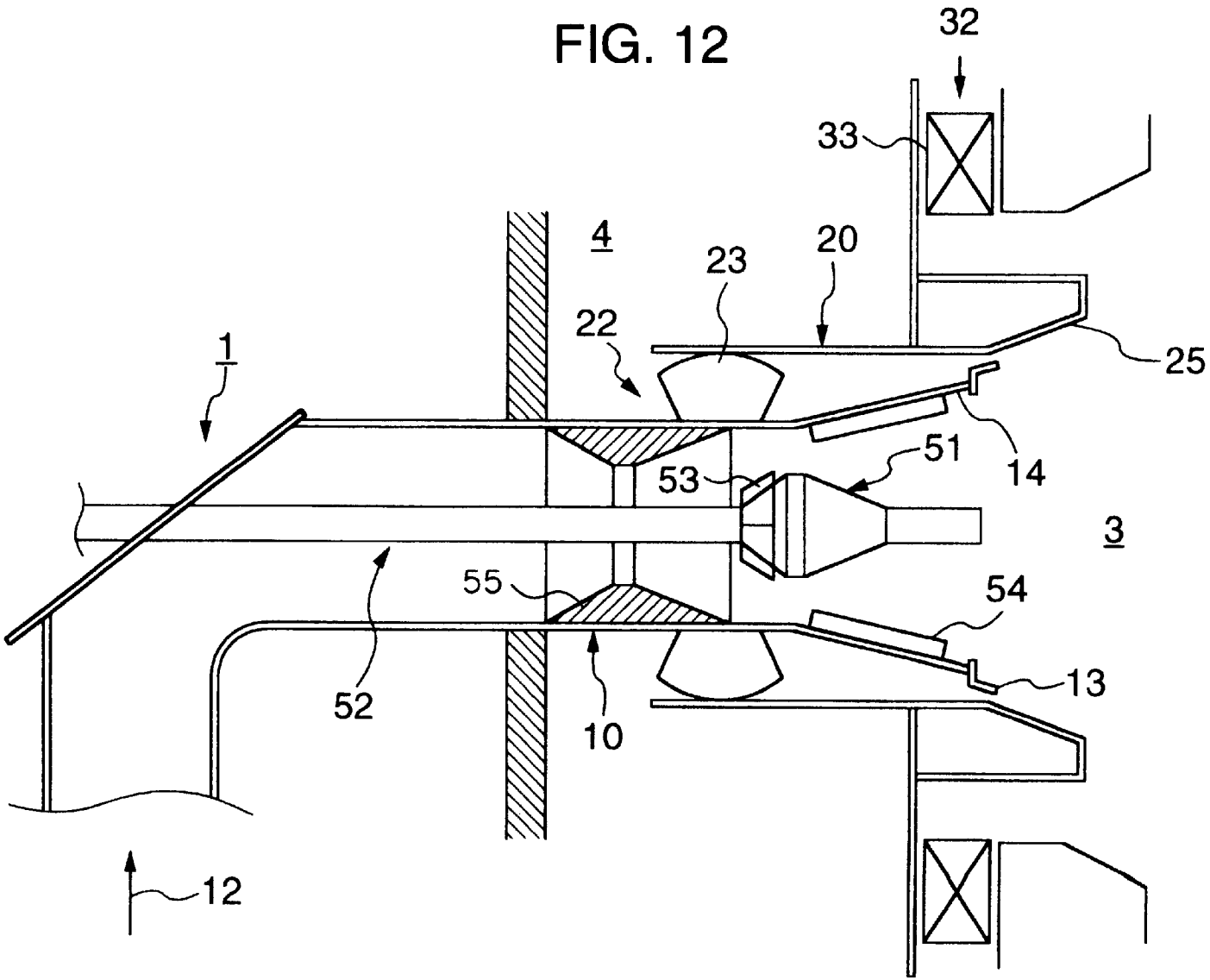

As compared with the embodiment of FIG. 11, a burner 1 of FIG. 12, which is a further embodiment, has an annular spacer 25 instead of the annular deflection guide tube 24, the spacer 25 being provided at a distal end of the gas supply nozzle 20. An inner peripheral surface of the spacer 25 is so flared that its diameter increases progressively along the flow of mixture, and an outer peripheral surface of the spacer 25 is parallel to an axis of the mixture nozzle 10. An end of the inner peripheral surface of the spacer 25 and an end of the outer peripheral surface thereof are interconnected by an end wall disposed perpendicular to the axis of the mixture nozzle 10. With this construction, the secondary air 22 flows along the flared inner peripheral surface of the spacer 25, and is spread into a furnace 3 as in the above embodiment. The tertiary air 23 flows along the outer peripheral surface of the spacer 25, and is supplied into the furnace 3 from a radially-outward position, and therefore is mixed with the flame 5 with a delay at a position far from the burner 1. As a result, the reduction areas are formed in the vicinity of the burner 1, and the generation of NOx can be suppressed.

Figure 13:
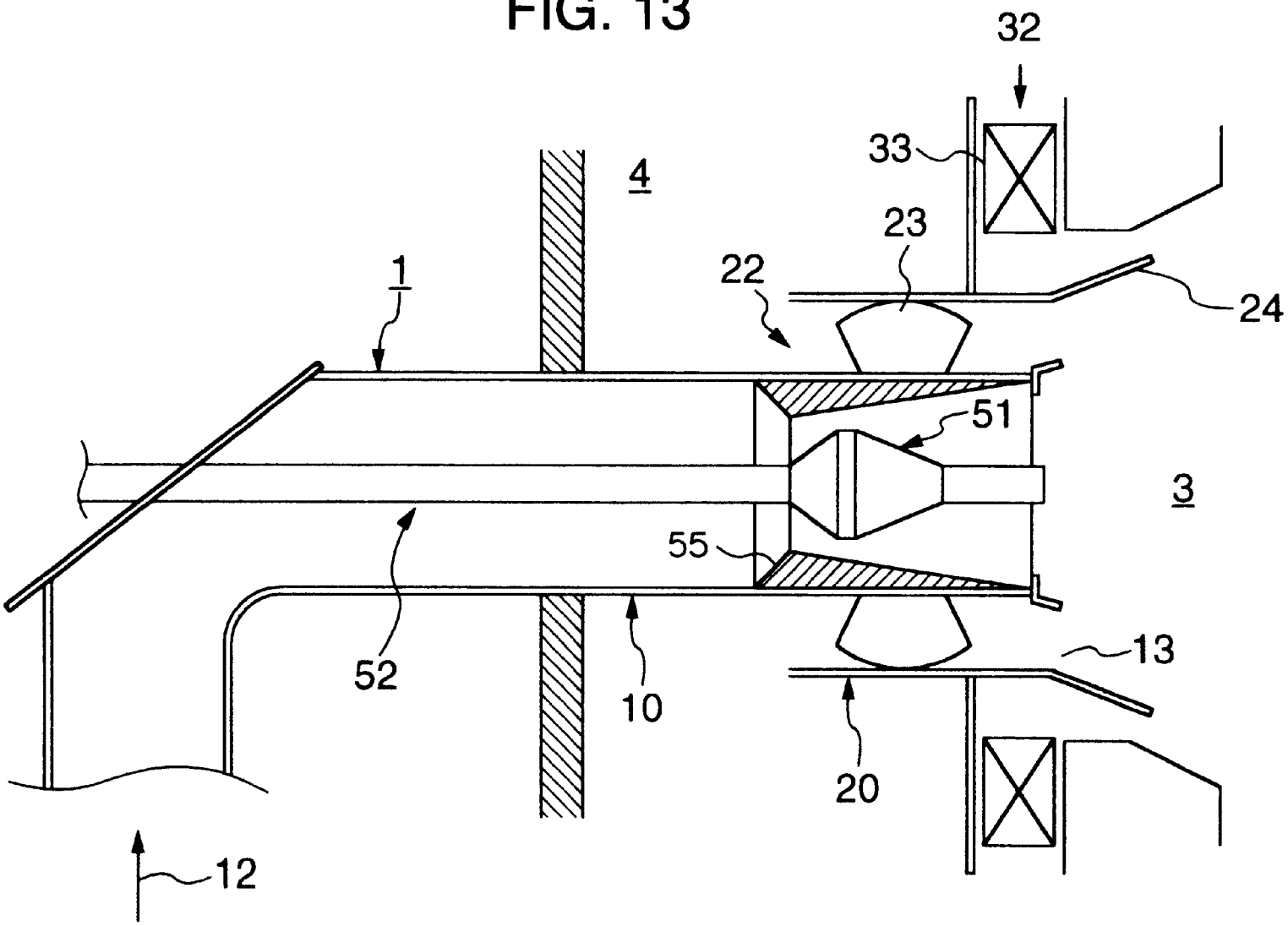

As compared with the embodiment of FIG. 1, a burner 1 of FIG. 13, which is a further embodiment, includes the mixture nozzle 10 whose distal end portion is not flared. The venturi tube 55 having a throat portion is provided inside the distal end portion of the mixture nozzle 10 in opposed to the guide 51. In this embodiment, the mixture 12 out from the throat portion flows along a flared inner peripheral surface of the Venturi tube 55 by means of the guide 51, and is spread into the furnace 3. If the guide 51 is disposed downstream of the throat portion of the Venturi tube as shown in the drawings, a larger amount of the pulverized coal flows along the inner peripheral surface of the Venturi tube 55, and can be supplied into the furnace 3 in an outwardly-spread manner.

Figure 15:
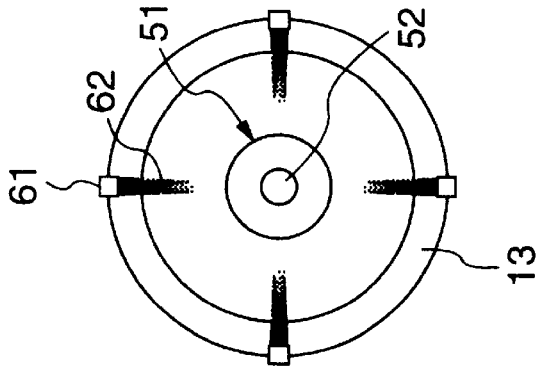
FIG. 15 is a cross-sectional view taken along the line XV—XV of FIG. 14.
Figure 14:
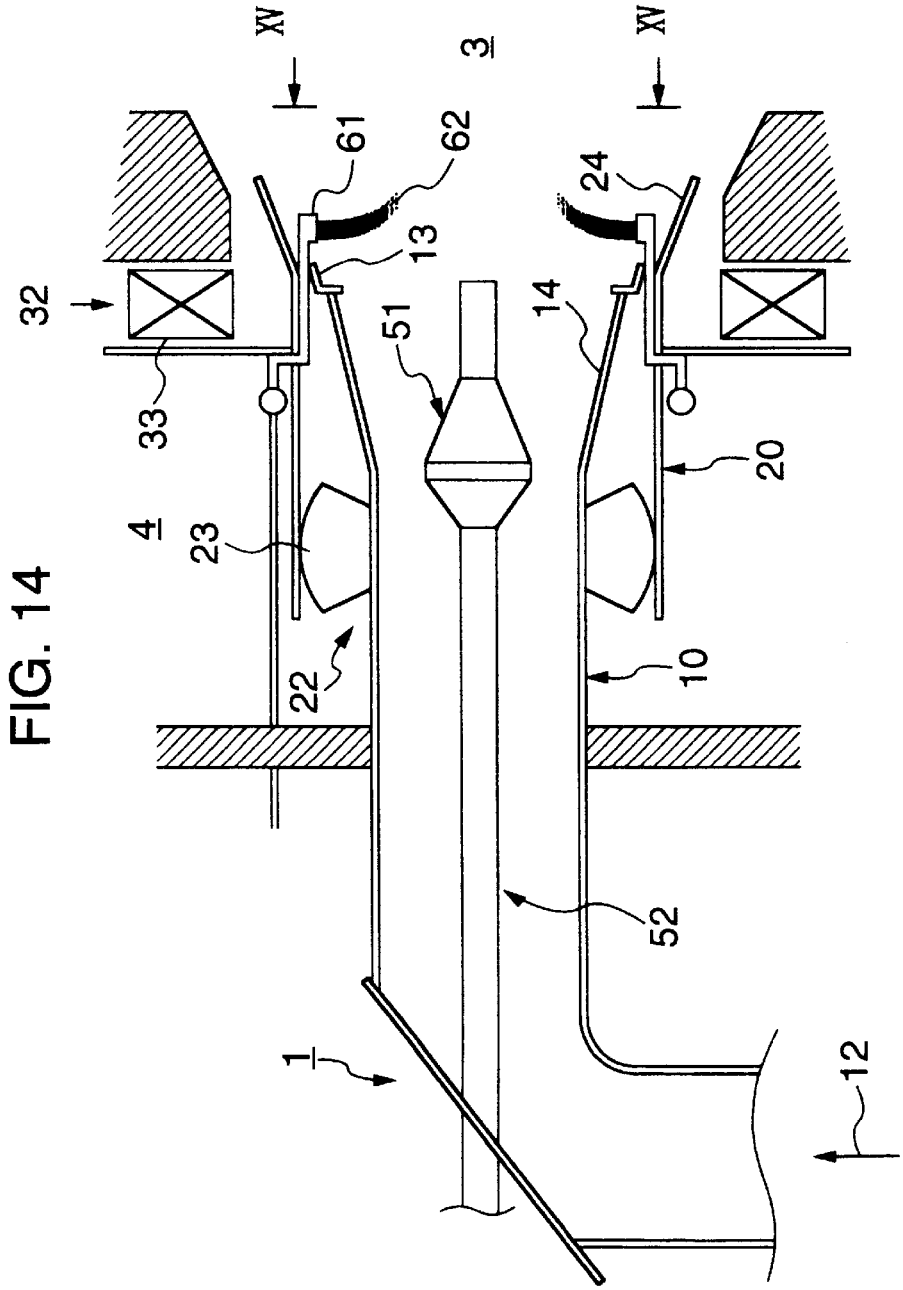
FIG. 14 is a cross-sectional view showing a further embodiment of a burner.
Figure 15A:
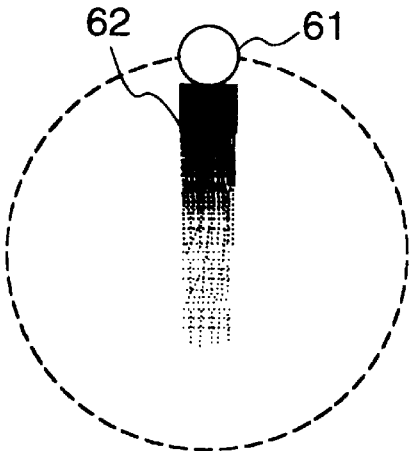
FIGS. 15A to 15D are front-elevational views respectively showing modified air injection nozzle constructions of a burner of FIG. 14.
Figure 15B:
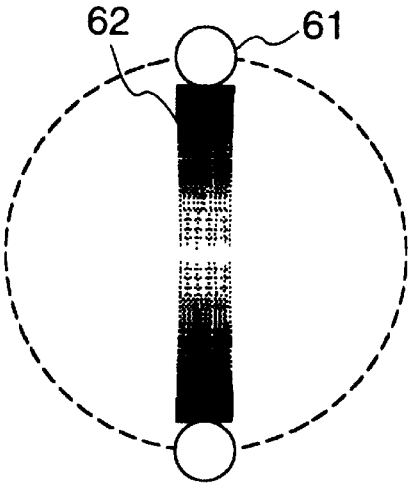
Figure 15C:
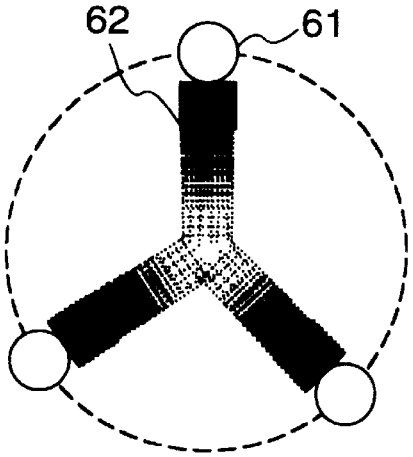
Figure 15D:
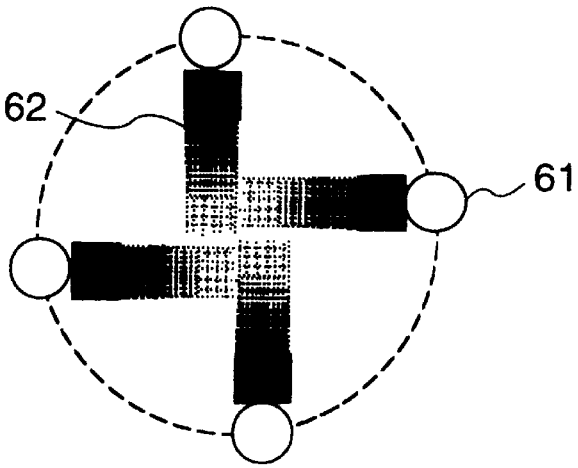

As compared with the embodiment of FIG. 1, a burner 1 of FIG. 14, which is a further embodiment, further comprises air injection nozzles 61. Four air injection nozzles 61 (though the number of nozzles is not significant) are circumferentially equiangulary spaced from each other (FIG. 15). As shown in FIGS. 15A to 15C, the number of the nozzles 61 may be 1 to 3, or may be 5 or more. Further, as shown in FIG. 15D, there may be used an arrangement in which injected air jets 62 are slightly deviated from an axis of the mixture nozzle. Further, as shown in FIG. 15A, the nozzles 61 may not be arranged equiangulary.

Figure 16:
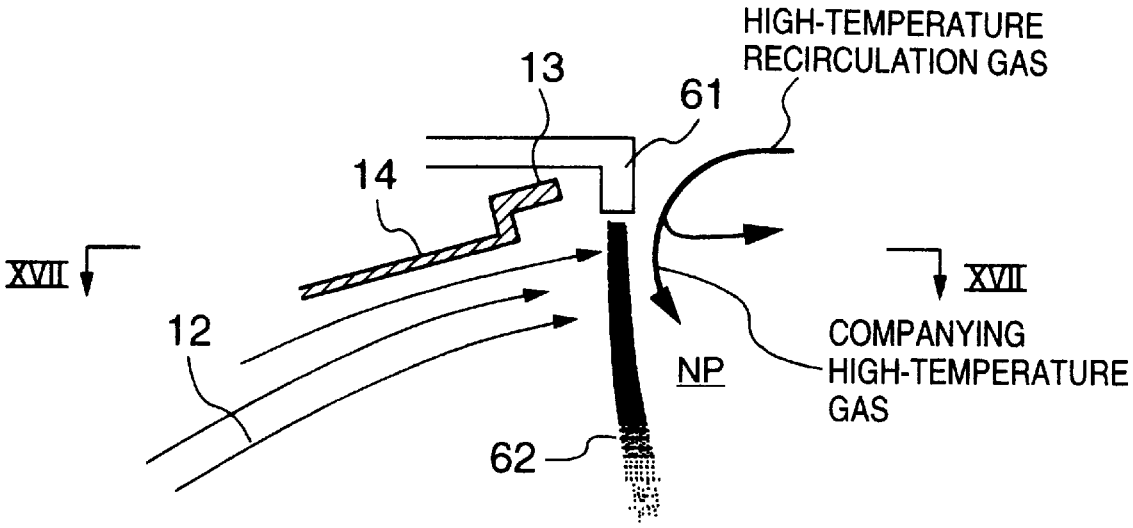
FIG. 16 is a fragmentary, cross-sectional view showing a condition of flow of a mixture and a condition of flow of combustion gas in the vicinity of an outlet of the burner shown in FIG. 14.
Figure 17:
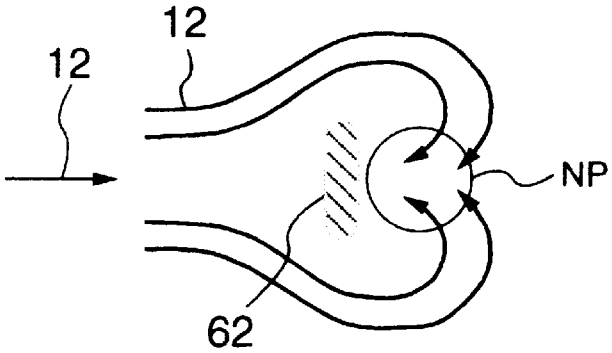
FIG. 17 is a cross-sectional view taken along the line XVII—XVII of FIG. 16.

The air injection nozzles 61 are provided immediately downstream of the flame stabilizer 13, and disposed between the mixture nozzle 10 and the gas nozzle 20. The air injection nozzles 61 are interconnected by pipes, and communicate with an external air compressor means. The prewarmed air 62 from the air compressor means is injected through the nozzle 61 toward the mixture flow in a direction substantially perpendicular to the axis of the mixture nozzle. As a result, as shown in FIGS. 16 and 17, a stagnation point is formed in the flow of the mixture 12 due to the injected air 62, and a relatively-negative pressure area NP is formed downstream of the injected air 62 with respect to the flow of the mixture 12. High-temperature combustion gas is carried by the injected air 62 into the negative pressure area NP, thereby promoting the ignition of pulverized coal in the mixture. As a result, the combustion in reduction areas is promoted, and also the flame temperature rises in the vicinity of the burner 1, thereby promoting the expansion of the flame.

The air injection nozzles 61 may be movable in the direction of the axis of the mixture nozzle so as to effect the optimum air injection in accordance with combustion properties of the pulverized coal as solid fuel, a burner load, combusting conditions and so on. Further, an air injection nozzle may be so arranged that it can swing in a plane perpendicular to the axis of the mixture nozzle. If the injection nozzles 61 are directed slightly toward the upstream side of the mixture 12, an ignition area can be increased. Accordingly, high-fuel ratio coal and coarse pulverized coal whose ignition properties are not good can be used as solid fuel.

Figure 19:
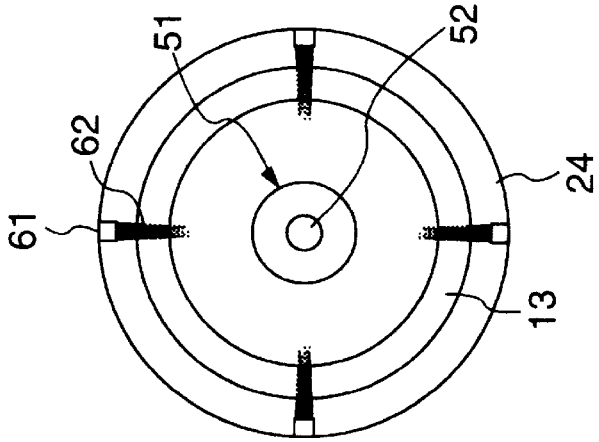
FIG. 19 is a cross-sectional view taken along the line XIX—XIX of FIG. 18.
Figure 18:
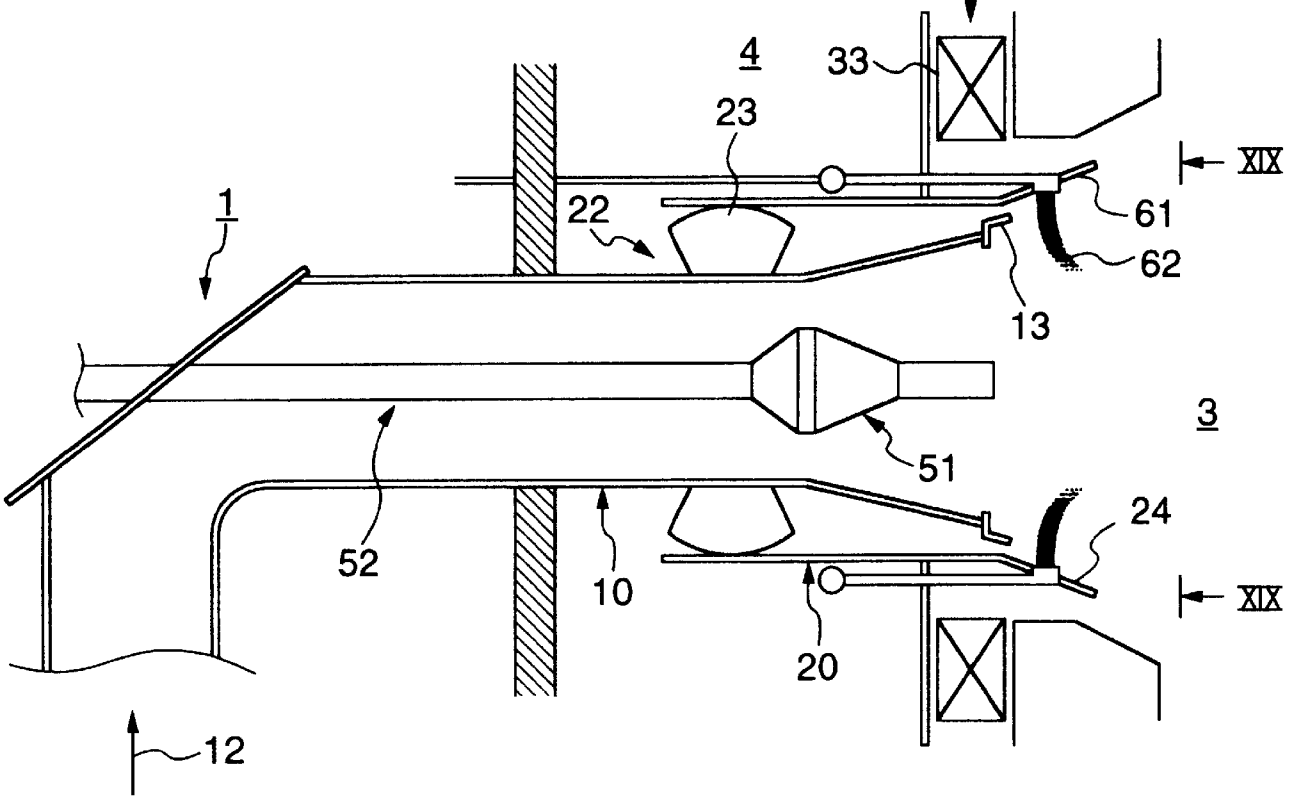
FIG. 18 is a cross-sectional view showing another embodiment of a burner.

A burner 1 shown in FIGS. 18 and 19 differs from the burner of FIG. 14 in the positions of mounting of air injection nozzles. As shown in FIG. 19, the air injection nozzles 61 are disposed immediately downstream of the flame stabilizer 13, and are provided on the annular deflection guide tube 24 of the gas nozzle 20. Air 62 is injected from the air injection nozzle 61 toward a flow of the mixture. In order to inject the air 62 in such a manner that it can pass through the secondary air and the mixture, a greater energy is needed as compared with the burner of FIG. 14. However, a larger amount of high-temperature combustion gas is carried by the injected air 62 and flowed into the negative pressure area NP. Therefore, this is suitable for burning high-fuel ratio pulverized coal (having a smaller amount of volatile components).

Figure 20:
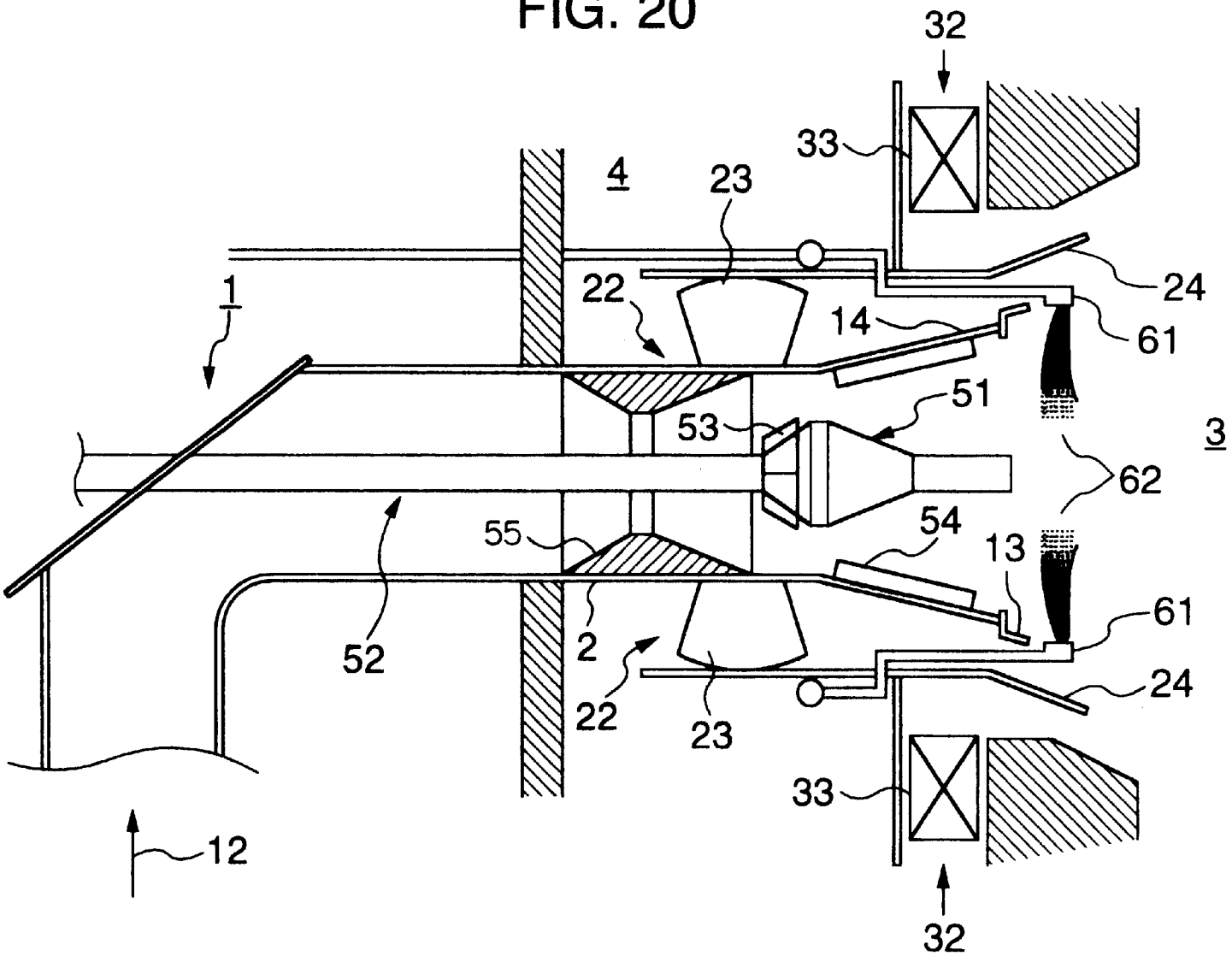
FIG. 20 is a cross-sectional view showing a further embodiment of a burner.

A burner 1, shown in FIG. 20, is a combination of the constructions of FIGS. 11 and 14. The above-mentioned operations and effects can be enjoyed in a combined manner.

The present invention can be used as a combustion apparatus, for example a coal-burning boiler.

What is claimed is:

1. A combustion burner comprising:

a mixture nozzle which extends toward an interior of a furnace, and defines a mixture passage through which a mixture containing powdered solid fuel and gas for transferring said solid fuel flows, said mixture nozzle having a distal end portion extending to a distal end of said mixture nozzle, the distal end portion being flared so that an entire flow passage area of said mixture passage in the distal end portion increases progressively to the distal end in a direction of flow of said mixture;

a flame stabilizer provided at the distal end portion of said mixture nozzle;

a gas supply nozzle radially surrounding said mixture nozzle and defining between said gas supply nozzle and said mixture nozzle a gas passage through which combustion oxygen-containing gas flow toward said furnace; and a flow guide provided within said mixture nozzle at a position upstream of said flared portion of said mixture nozzle with respect to a flow of said mixture so as to make said mixture flow radial outwardly along an inner peripheral surface of said flared portion of said mixture nozzle.

2. A combustion burner according to claim 1, in which said flow guide is provided at a position corresponding to an interconnecting portion between the flared portion of said mixture nozzle and the remainder of said mixture nozzle with respect to the direction of flow of said mixture.

3. A combustion burner according to claim 1, further comprising a swirl portion provided on said guide so as to swirl said mixture, and a rectifier provided on an inner peripheral surface of said flared portion of said mixture nozzle so as to rectify the swirled mixture.

4. A combustion burner according to claim 1, in which said gas supply nozzle defines a secondary air passage between said gas supply nozzle and said mixture nozzle, and a tertiary air passage between said gas supply nozzle and an opening formed in said furnace, and in which said burner further comprises separation means for radially separating the flow of said mixture flowing from the distal end of said mixture nozzle into said furnace, from the flow of said combustion oxygen-containing gas flowing from said tertiary air passage into said furnace.

5. A combustion burner according to claim 1, in which a distal end portion of said gas supply nozzle is flared, and an angle between said flared distal end portion of said gas supply nozzle and an axis of said gas supply nozzle is substantially equal to or larger than an angle between the flared distal end portion of said mixture nozzle and an axis of said mixture nozzle.

* * * * *